US010247500B2

(12) United States Patent
Owens et al.

(10) Patent No.: US 10,247,500 B2
(45) Date of Patent: Apr. 2, 2019

(54) MODULAR BOLT ASSEMBLY WITH FLOATING FIRE PIN

(71) Applicant: FN AMERICA, LLC, Mclean, VA (US)

(72) Inventors: James Owens, Mclean, VA (US); Stefan Holme, Erding (DE); Hannes Aberl, Erding (DE)

(73) Assignees: FN AMERICA, LLC, McLean, VA (US); UNIQUE ALPINE AG, Erding (DE)

( * ) Notice: Subject to any disclaimer, the term of this patent is extended or adjusted under 35 U.S.C. 154(b) by 0 days.

(21) Appl. No.: 15/519,256

(22) PCT Filed: Oct. 13, 2015

(86) PCT No.: PCT/US2015/055310
§ 371 (c)(1),
(2) Date: Apr. 14, 2017

(87) PCT Pub. No.: WO2016/061092
PCT Pub. Date: Apr. 21, 2016

(65) Prior Publication Data

US 2017/0227314 A1 Aug. 10, 2017

Related U.S. Application Data

(60) Provisional application No. 62/063,459, filed on Oct. 14, 2014.

(51) Int. Cl.
*F41A 11/02* (2006.01)
*F41A 3/16* (2006.01)
(Continued)

(52) U.S. Cl.
CPC ..... *F41A 11/02* (2013.01); *F41A 3/12* (2013.01); *F41A 3/16* (2013.01); *F41A 3/18* (2013.01)

(58) Field of Classification Search
CPC ..... F41A 11/02; F41A 3/12; F41A 3/18
(Continued)

(56) References Cited

U.S. PATENT DOCUMENTS 604,904 A 5/1898 Parkhurst
2,950,653 A 8/1960 Harvey
(Continued)

OTHER PUBLICATIONS

International Search Report and Written Opinion dated Jan. 24, 2016; and International Preliminary Report on Patentability dated Mar. 24, 2017 in PCT/US2015/0555310 filed Oct. 13, 2015.

*Primary Examiner* — Joshua E Freeman
(74) *Attorney, Agent, or Firm* — Williams Mullen, PC

(57) ABSTRACT

A modular bolt assembly may include a bolt body, a striker assembly, and one or more removable bolt, head having a floating fixing pin, The removable bolt head may have a cartridge engagement surface, a back end that removably mates with a bolt body, and a floating firing pin with a front end that contacts a cartridge primer, and a rear end that receives force from the striker assembly. Bolt heads may be included for different caliber cartridges, allowing the modular bolt assembly to be used with different types of ammunition, the floating firing pin prevents the striker assembly from directly contacting a chambered round without the bolt head, thereby preventing catastrophic failure during use if a boll head is not present and properly positioned.

21 Claims, 10 Drawing Sheets

SIDE

FRONT

TOP

(51) Int. Cl.
*F41A 3/12* (2006.01)
*F41A 3/18* (2006.01)

(58) Field of Classification Search
USPC ..... 42/16
See application file for complete search history.

(56) References Cited

U.S. PATENT DOCUMENTS 3,253,362 A * 5/1966 Gitchell ..... F41A 3/74 42/16
3,473,719 A * 10/1969 John ..... B25C 1/123 227/11
3,631,620 A * 1/1972 Ohira ..... F41A 3/22 42/16
3,745,683 A * 7/1973 Koon, Jr. ..... F41A 3/22 42/16
3,745,686 A * 7/1973 Koon, Jr. ..... F41A 3/12 42/16
4,402,152 A * 9/1983 Casull ..... F41A 15/14 42/16
5,718,073 A * 2/1998 Sachse ..... F41A 3/24 42/16
6,061,944 A 5/2000 Schroeder
6,145,234 A * 11/2000 Fluhr ..... F41A 15/12 42/25
7,895,786 B2 * 3/2011 Caulley ..... F41A 3/22 42/69.02
8,302,340 B1 * 11/2012 Irwin ..... F41A 3/22 42/16
8,429,844 B2 4/2013 Dextraze
8,925,230 B2 * 1/2015 Warburton ..... F41A 3/22 42/16
9,157,696 B2 * 10/2015 Dextraze ..... F41G 11/003
9,163,888 B1 * 10/2015 DiOrio ..... F41A 3/24
9,194,635 B1 11/2015 Gibbens
9,239,203 B2 * 1/2016 Jarboe ..... F41A 3/18
9,429,382 B2 * 8/2016 Ives ..... F41A 3/22
2006/0112604 A1 * 6/2006 Stone ..... F41A 19/13 42/69.01
2010/0313459 A1 * 12/2010 Gomez ..... F41A 17/66 42/70.08
2017/0227314 A1 * 8/2017 Owens ..... F41A 3/12

* cited by examiner

MODULAR BOLT ASSEMBLY WITH FLOATING FIRE PIN

CROSS REFERENCE TO RELATED APPLICATIONS

This application is a United States National Phase application which claims the benefit of International Patent Application No. PCT/US2015/05531, filed Oct. 13, 2015, which claims priority of U.S. Provisional Application No. 62/063,459, filed Oct. 14, 2014, the contents of both of these applications are incorporated by reference in their entirety.

STATEMENT REGARDING GOVERNMENT SUPPORT

None.

FIELD

The present disclosure relates to a modular bolt assembly for a modular, multi-caliber firearm, such as a modular bolt-action rifle.

BACKGROUND

Modularity is becoming an important feature in the firearm industry. Generally, a modular firearm is a firearm that may be reconfigured with one or more different components to change the operation, function, size and/or shape, and/or capabilities of the firearm. Barrel length and rifling, muzzle type, muzzle brake, flash suppressor, compensator, magazine capacity, butt stock length and type, are examples of commonly adjustable components of a typical modular system. Modular firearms may also provide for multiple caliber configurations, i.e., a user may reconfigure the firearm for use with more than one caliber cartridge.

Modular firearms may be formed of modular components, each of which may be replaced with an identical component for repair and maintenance, or a variant component that provides a change in operation, function or capability, for example. Typically, a modular rifle includes a barrel, a chassis and receiver, a firing mechanism that may include a bolt assembly and a trigger assembly, and a butt stock. Some modular rifles enable a user to reconfigure the firearm for use with different caliber ammunition, such as by replacing caliber-specific barrel, magazine, and bolt assembly components for similar components configured for a different caliber, for example.

The ability to reconfigure a firearm for use with different caliber ammunition is valuable for several reasons. First, certain calibers of ammunition can be very expensive, whereas other calibers may be significantly more affordable. The latter ammunition category may be used in high volume for training purposes, while the former ammunition category may be used in low volume for operational purposes, competition, and the like. A firearm that may be reconfigured for use with either ammunition category allows a user to practice and train with the more affordable ammunition, building repetition knowledge (e.g., muscle memory) and experience with the firearm, and easily transition to using the more expensive ammunition for other purposes. Also, ammunition types are designed for different purposes. As examples, some calibers are designed for long-range anti-personnel or anti-materiel use, other calibers are designed for target shooting, and other calibers are designed for game hunting. Thus, a firearm that may use more than one type or caliber of ammunition may be configured for more than one role or purpose, increasing the range of roles that the firearm may fulfill.

One of the challenges with a modular firearm is providing a reconfiguration process which is not complicated and cumbersome, and does not require extensive, complicated, or unusual tools. Ideally, the reconfiguration process involves a minimum number of parts, and requires few tools (if any) to complete the modification. Also, the reconfiguration process should be as safe as possible. A primary design consideration is the safety of the firearm throughout the entire reconfiguration process. The process itself must allow a user to safely reconfigure the firearm in numerous conditions, including the full range of low-stress environments to highly stressful operational situations. The process must also account for the human error factor, in which a user may not (for myriad reasons) correctly perform the reconfiguration process. For example, a user may fail to include all components during reassembly, or improperly align components. Ideally, the reconfiguration process is a simple and straightforward such that a user either cannot physically complete the process without doing so correctly, or the firearm does not function in a state of an incomplete or incorrect reconfiguration.

These considerations apply to the bolt assembly in a modular firearm. For many multi-caliber modular firearms, the bolt head is specific to the caliber. Thus, to configure the firearm for use with more than one caliber ammunition, one option is to provide a bolt assembly that is specific to each caliber. This option is cumbersome and expensive. Other options employ a removable bolt head that mates with a bolt body and handle, such that only the bolt head need be replaced to reconfigure the firearm for use with a different caliber.

U.S. Pat. No. 8,429,844 to Dextraze et al. ("Dextraze") describes such a modular bolt assembly with a bolt head that may be removed from the bolt body, for use with a bolt-action rifle. Dextraze teaches varying the bolt head depending on the desired configuration, such as for use with a specific caliber. Dextraze's firing pin assembly may be inserted into a hollow bolt body and bolt head. The bolt head may be locked in position through a locking pin that fits through the bolt body and bolt head, as well as the firing pin assembly fitting into the bolt head.

There is a significant safety concern with bolt assemblies similar to the type described by Dextraze: because the firing pin extends from the striker assembly, the firing pin can be activated in the absence of the bolt head. Engaging the firing mechanism may cause the firing pin to strike the primer, even if the bolt head is not installed. As a consequence, the primer in a cartridge can ignite and the resulting explosive forces release through the open chamber, magazine well, ejector port, etc., causing severe injury to the user and potentially catastrophic damage to the firearm and surroundings. In other words, firing mechanisms such as the mechanism Dextraze discloses may be capable of operating even if the user fails to replace the bolt head during assembly, during reconfiguration, or after maintenance, for instance, and is therefore a significant health and safety risk. Also, an exposed firing pin, such as in the Dextraze mechanism, is easily damaged through handling. Damage to the unprotected end of the firing pin can change the shape and overall firing pin length, which may result in inconsistent primer strikes, possibly resulting in misfire.

What is needed is a self-aligning modular bolt assembly capable of being reconfigured with a caliber-specific bolt head that does not contact the primer if improperly or incompletely assembled.

BRIEF SUMMARY

It is an object of this disclosure to provide a safe and self-aligning modular bolt assembly for use with a multi-caliber firearm, such as a modular bolt-action rifle. As disclosed herein, embodiments of a modular bolt assembly may feature a bolt head with a self-contained floating firing pin, a bolt body, and a striker assembly configured to be inserted through the bolt body and into the bolt head. The striker may contact or be in close proximity to the floating firing pin when the striker assembly is inserted into the bolt head, such that engaging the firing mechanism causes the striker to rapidly push the floating firing pin forward and engage the primer of a loaded cartridge. Should a user desire to reconfigure the bolt assembly for use with a different caliber, then the user may remove the bolt head from the bolt assembly and replace it with a bolt head configured for the desired caliber. Further, embodiments of the bolt head and the striker assembly may each be removably mated with the bolt body in a self-aligning manner, such that assembling the components causes those components to properly align for use in the firearm. Embodiments may include tool-free mechanisms for connecting components, such as threaded connections and sliding interlocks, for example. Embodiments of the modular bolt assembly may be adapted for use in various firearms, such as a modular rifle. Embodiments of the modular bolt assembly may also be adapted for use with various firearm actions, such as bolt-action firearms.

It is an object of this disclosure to provide a modular bolt assembly capable of being reconfigured with a caliber-specific bolt head, yet providing the valuable safety feature of precluding firing of the firearm in the absence of the bolt head. Embodiments of the bolt head may feature a floating firing pin, wholly or partially contained in or mounted within the bolt head and having a front end configured to contact a cartridge primer, and a rear end configured to receive force from a striker assembly. The bolt head may include a back end configured for removably mating with a bolt body. If the bolt head with the floating firing pin is not present in the bolt assembly, then engaging the firing mechanism does not cause the cartridge primer to ignite because the floating firing pin is not present.

It is a further object of this disclosure to reduce the potential harm due to human error, and in particular the potential harm due to a user's failure to properly include the bolt head when preparing a modular bolt assembly for use in a modular firearm. Unlike integral or one-piece firing pin and striker components, embodiments of the modular bolt assembly disclosed herein may include a floating firing pin wholly or partially contained in or mounted within the bolt head. The floating firing pin is disconnected from the striker when the bolt head is not connected to the bolt assembly. As a result, embodiments may be incapable of igniting the primer in a cartridge if the bolt head is not included, or if the bolt head is not properly connected to the bolt body.

To accomplish the foregoing and related ends, certain illustrative embodiments of the present approach are described herein in connection with the following description and the annexed drawings. These embodiments are indicative, however, of but a few of the various ways in which the principles of the present approach may be employed, and the present approach is intended to include all such aspects and their equivalents. Other advantages, embodiments and novel features of the present approach will become apparent from the following description when considered in conjunction with the drawings. The following description is given by way of example, but not intended to limit the scope of this disclosure solely to the specific embodiments described, which can be understood in conjunction with the materials that follow.

Embodiments of the present approach may include a removable bolt head for a modular bolt assembly. The removable bolt head may include a cartridge engagement surface, a back end that removably mates with a bolt body, and a floating firing pin having a primer contact surface and a striker contact surface. In some embodiments, the floating firing pin has a front end that contacts a cartridge primer, and a rear end that receives force from a striker assembly. In some embodiments, the removable bolt head includes a head portion and plurality of locking lugs. The head portion and locking lugs mate with a corresponding receiver and chassis system. Also, the head portion may define a cartridge engagement surface. The cartridge engagement surface may include an opening through which the floating firing pin's primer contact surface may pass to contact a cartridge, such as during operation of the firing mechanism. The floating firing pin may be mounted within the bolt head. In some embodiments, a spring biases the floating firing pin in a retracted position, e.g., away from the bolt head's cartridge contact surface. In such embodiments, the firing mechanism may cause the striker assembly to project forward and contact the firing pin with sufficient force to overcome the spring force and proceed forward, such that the floating firing pin's primer contact surface passes through an opening in the cartridge engagement surface. The floating firing pin in some embodiments may have an hour glass body to assist with controlling movement of the firing pin during and after firing. For example, the floating firing pin may have a front end and a back end, and a cylindrical portion extending from the body's front end, the cylindrical portion defining the primer contact surface. In some embodiments, a portion of the cylindrical portion may be the portion of the firing pin that passes through the engagement surface opening to contact a cartridge.

In some embodiments, the bolt's back end may have a T-shaped locking structure for removably mating with the bolt body. The bolt head in some embodiments may include a channel for receiving a portion of a striker assembly, the floating firing pin positioned in the channel such that the portion of a striker assembly may contact the striker contact surface.

Embodiments may take the form of a modular bolt assembly. The bolt assembly may include a bolt body, a striker assembly, and a removable bolt head having a floating firing pin. The bolt assembly in some embodiments may feature a self-aligning locking mechanism that enables the removable bolt head to removably mate with the hollow bolt body. For example, the self-aligning locking mechanism in some embodiments may have a T-shaped locking structure and corresponding T-shaped groove. The bolt body may have a bore for receiving a portion of the striker assembly. The striker assembly may removably mate with the bolt body. For example, a portion of the striker assembly may extend through a bore in the bolt body. The bolt head may include a channel for receiving a portion of the striker assembly, such as a portion extending from the bolt body's bore, such that an end of the striker assembly contacts the striker contact surface of the floating firing pin.

Embodiments of the present approach may take the form of a modular firearm having a barrel, a receiver and chassis, and a bolt assembly, the bolt assembly comprising a bolt body, a striker assembly, and a removable bolt head having a floating firing pin.

Embodiments of the present approach may take the form of a modular bolt assembly system. The system may include a bolt body, a striker assembly, and one or more bolt heads having a floating firing pin. Each bolt head may be configured for use with an associated caliber cartridge. Embodiments may also take the form of a method of striking a cartridge primer with a floating firing pin. For example, the method may include first engaging a firing mechanism connected to a modular bolt assembly having a bolt body, a striker assembly, and a bolt head, the bolt head removably mated with the bolt body and having a floating firing pin, wherein engaging the firing mechanism propels the striker assembly toward a striker contact surface of floating firing pin. Next, contacting the striker contact surface of floating firing pin with the striker assembly, then pushing the floating firing pin toward a cartridge contact surface of the bolt head, a distance sufficient for a primer contact surface of the floating firing pin to protrude through an opening in the cartridge contact surface of the bolt head and contact the cartridge primer. In some embodiments, contacting the striker contact surface of floating firing pin with the striker assembly may involve the striker assembly exerting a pushing force on the floating firing pin adequate to overcome a spring tension on the floating firing pin, thereby causing the floating firing pin to move in the direction of the cartridge.

DESCRIPTION

As discussed herein, a modular bolt assembly may include a bolt head with a floating firing pin, a bolt body, and a striker assembly. The bolt head may be configured for use with a specific caliber, such that a user desiring to reconfigure a firearm for use with a specific caliber may include the bolt head for that caliber in the bolt assembly (and replace any other modular parts necessary to enable a firearm to function for the desired caliber). Embodiments of the bolt head may include a self-contained or floating firing pin wholly or partially contained in or mounted within the bolt head. The floating firing pin may have a front end configured to mechanically contact a cartridge primer, and a rear end configured to contact a striker assembly. The striker may be in mechanical contact or be in close proximity to the rear end of the floating firing pin when the striker assembly is connected to the bolt body and inserted into the bolt head, such that engaging the firing mechanism causes the striker to contact the rear end of the floating firing pin and rapidly push the floating firing pin forward.

Figure 1:
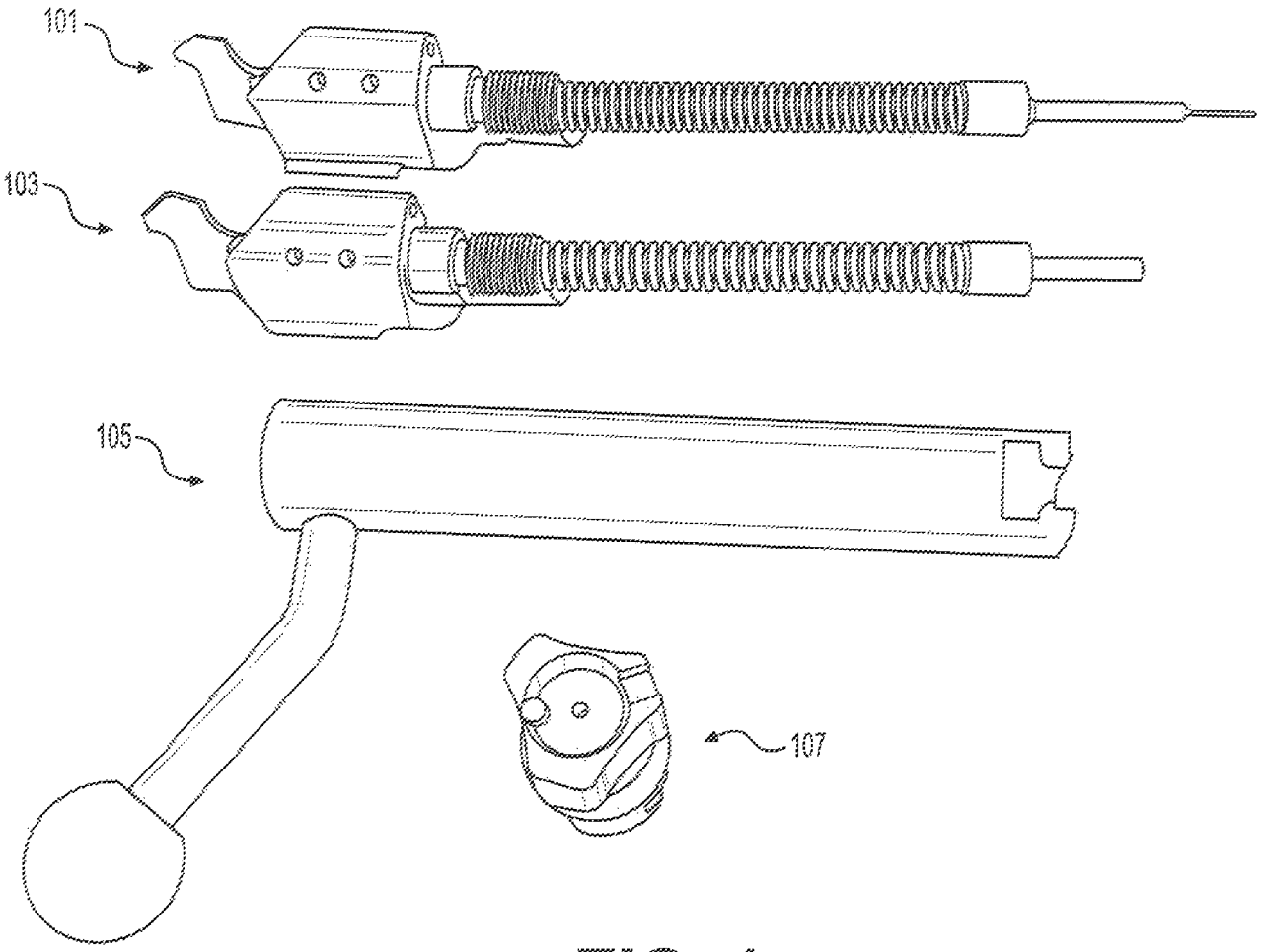
FIG. 1 is a photograph showing embodiments of a striker assembly with a firing pin, a striker assembly for a floating firing pin, a bolt body, and a bolt head.

FIG. 1 shows embodiments of an integral firing pin and striker assembly 101 according to a contemporary design, a striker assembly 103 configured for a floating firing pin according to an embodiment of the present disclosure, a hollow bolt body 105 according to an embodiment of the present disclosure, and a bolt head 107 according to an embodiment of the present disclosure. Bolt body 105 is described as a hollow bolt body herein because in this particular embodiment, the striker assembly 103 is configured to be inserted into a bore running the long axis of the bolt body 105 and secured through a threaded connection. However, other embodiments may rely on different methods to incorporate the striker assembly, and the term hollow bolt body is therefore not intended to be limited to bolt bodies having a hollow bore.

Figure 2:
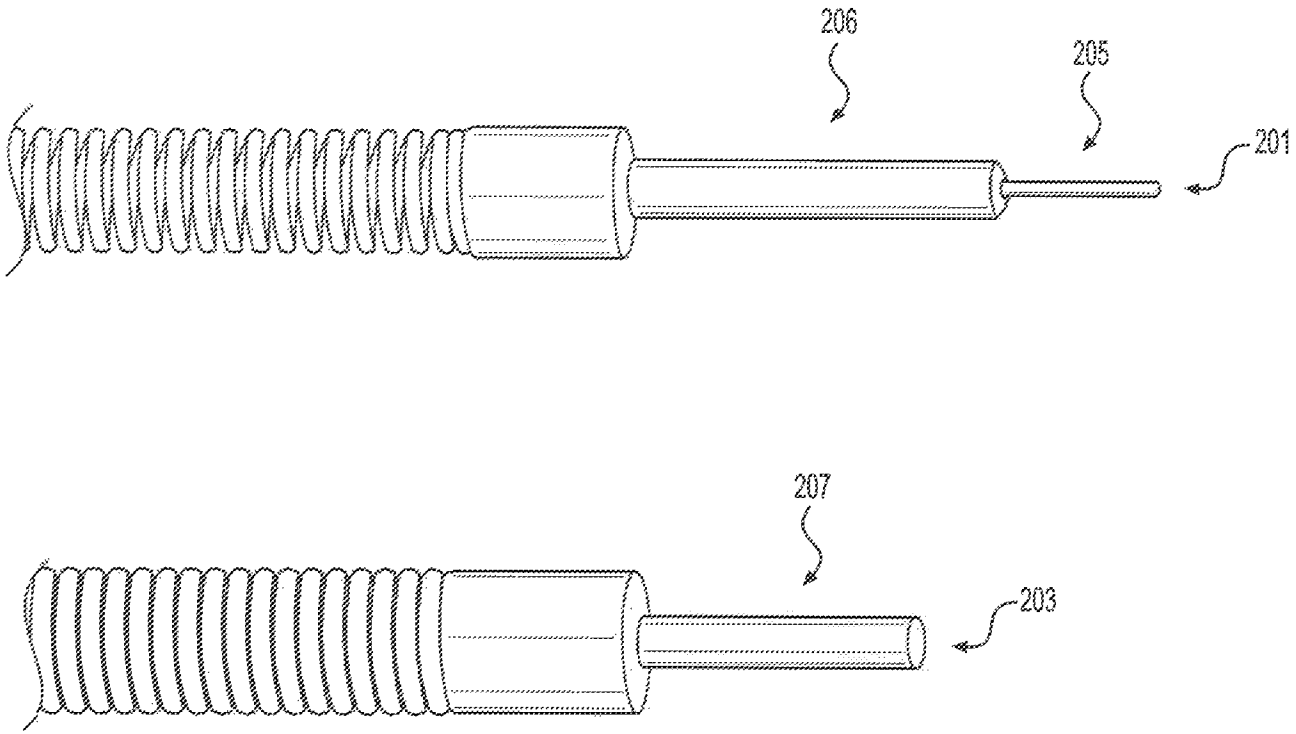
FIG. 2 is an enlarged photograph showing portions of embodiments of a striker assembly with a firing pin, and a striker assembly for a floating firing pin.

FIG. 2 shows portions of the integral firing pin and striker assembly 201 according to a contemporary design, and the striker assembly 203 configured for a floating firing pin shown in FIG. 1. The integral firing pin and striker assembly 201 includes a firing pin 205 protruding from an end of cylindrical member 206, and is configured for a mating engagement with a bolt head having a hollow portion through which the firing pin 205 extends when in the assembled position. As discussed above, this contemporary design may be capable of contacting a primer in the absence of a bolt head, leading to catastrophic failure and damage. On the other hand, the striker assembly 203 for a floating firing pin as described herein includes a cylindrical member 207 configured for a mating engagement with a bolt head having a floating firing pin (not shown). Because striker assembly 203 is not integral with the floating firing pin, it does not create the risk of contacting the primer in the absence of a bolt head.

Figure 3:
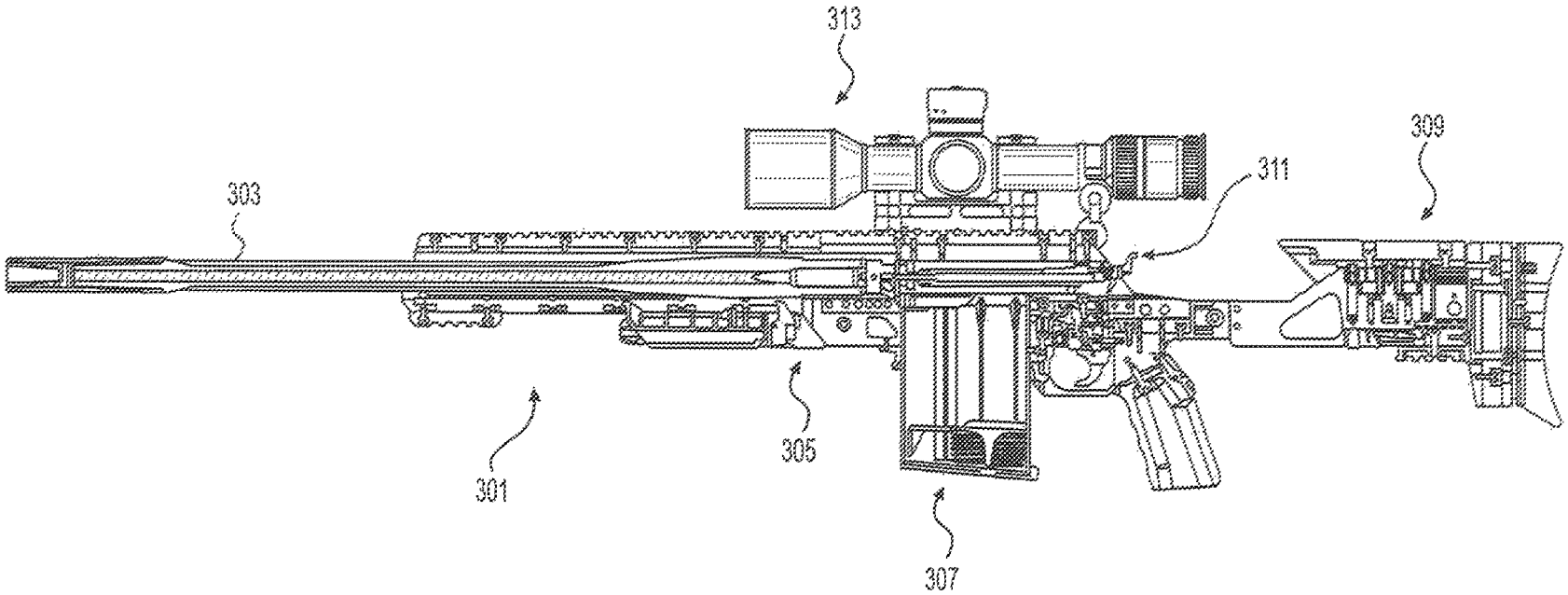
FIG. 3 is a schematic of a modular, multi-caliber firearm.

Embodiments of the modular bolt assembly may be incorporated into a firearm, such as the modular firearm 301 shown in FIG. 3. The modular firearm 301 in this embodiment is a bolt-action rifle, but other firearms may feature a modular bolt assembly as disclosed herein. Modular firearm 301 includes an interchangeable barrel 303 that removably mates with the receiver and chassis assembly 305. Magazine assembly 307, buttstock module 309, and bolt assembly 311 also removably mate with the receiver and chassis assembly 305. The firearm 301 may also include one or more accessories, such as a scope 313 removably mated with rails along the receiver and chassis assembly 305.

A user may remove and replace one or more of the modular components of the modular firearm 301. For instance, the user may reconfigure modular firearm 301 for use with different caliber ammunition, for example, by replacing modular components with an interchangeable barrel 303, magazine assembly 307, and bolt assembly 311, configured for use with the desired caliber ammunition. Some contemporary multi-caliber firearms require an entirely new bolt assembly 311 for each caliber configuration. However, replacing the entire bolt assembly 311 for each caliber is expensive, and requires a user to inconveniently carry multiple bolt assemblies. Other contemporary multi-caliber firearms feature a multi-component bolt assembly 311 including a striker assembly, bolt body, and bolt head, and require the user to change only the bolt head to reconfigure the bolt assembly 311 for use with different caliber ammunition. As discussed above, however, such contemporary multi-component bolt assemblies feature a firing pin that extends from the striker assembly. The result is that a user can activate the firing pin in the absence of the bolt head, causing a round to ignite in the chamber and leading to catastrophic failure, injury to the user and individuals and structures in the immediate vicinity, and destruction of the firearm. Unlike such unsafe bolt assemblies, embodiments of the modular bolt assembly described herein employ a floating firing pin that may be disconnected from the striker assembly, and thus the firing mechanism, when the bolt head is removed. The striker assembly connects to a rear end of a bolt body, and a bolt head with a floating firing pin connects to a front end of the bolt body. When fully assembled, the striker assembly may contact the floating firing pin (or, in some embodiments, another element causing contact with the floating firing pin), and enable the firing mechanism to function.

Figure 4:
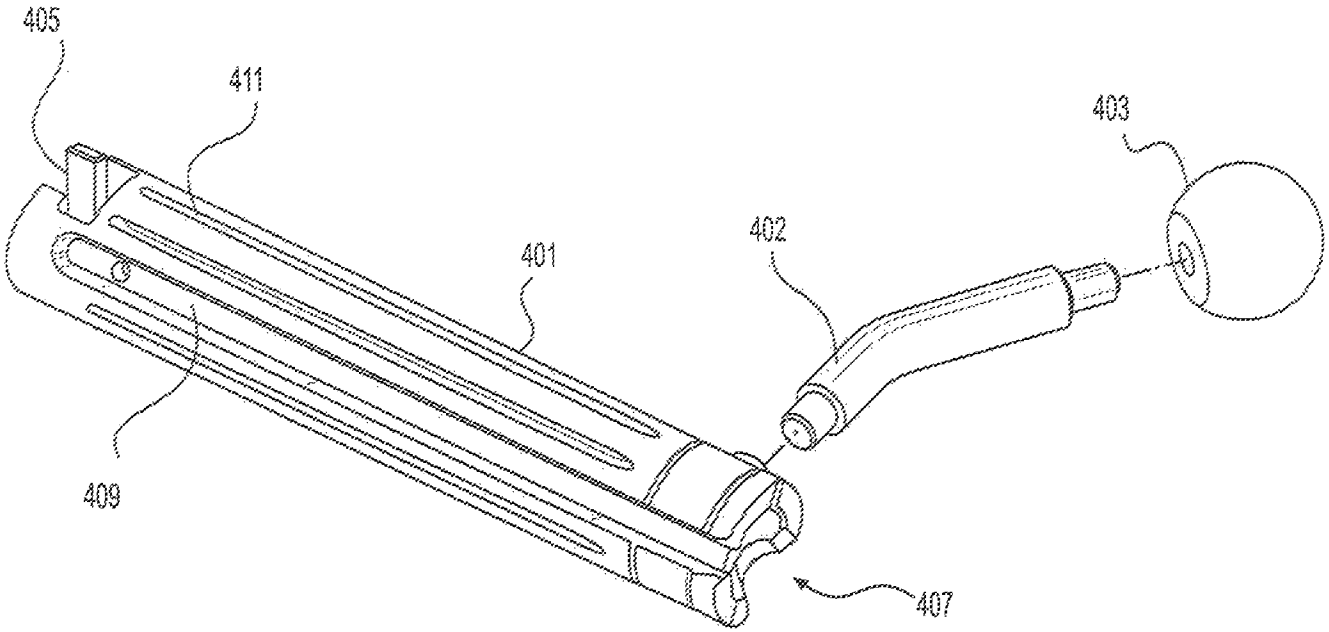
FIG. 4 is a drawing of a bolt body for a modular bolt-action rifle.

The hollow bolt body may take numerous forms, depending on the type of firearm and configuration of the receiver, and is not necessarily "hollow" in all embodiments. FIG. 4 shows an embodiment of a hollow bolt body configured for use with a bolt-action rifle. This embodiment features a generally cylindrical bolt main body 401, an actuating lever 402 attached to the main body 401, and a ball knob 403 attached to the actuating lever 402. Connection slot 405 at the front end of the main body 401 provides for connecting, through a sliding interlock, a bolt head (not shown) to the main body 401. The connection slot 405 in the embodiment shown in FIG. 4 has a T-shaped profile configured to securely receive a corresponding T-shaped structure in a bolt head. Of course, other geometries may be used to removably connect a bolt head to a bolt body without the use of a tool. Of course, alternative means may be used to removably connect a bolt head to a bolt body, with or without a tool. For instance, the bolt head may screw onto the bolt body (or vice versa) using corresponding threads and grooves. As another example, the bolt head and bolt body may feature corresponding protrusions and recesses to allow the components to self-align in the connected position. This disclosure is not limited to the specific embodiments disclosed herein.

Bolt body main body 401 may include a hollow bore 407 across the long axis of the bolt, for receiving and housing a striker assembly (not shown). As discussed herein, the striker assembly in other embodiments may connect to the bolt body without using a hollow bore, and thus this disclosure is not limited to a hollow bolt body. The main body 401 may feature fluting 409 and 411, for example, to assist with displacing foreign objects or debris that may interfere with bolt operation, for example, and may increase the overall surface area—and therefore the overall strength of the surface. In this embodiment, the actuating lever 402 and ball knob 403 form a bolt handle that permits a user to operate the bolt in a bolt action firearm. The shape and pitch of the actuating lever 402 may depend on various design factors, such as the design of the receiver. Of course, alternate bolt handle shapes, sizes, and configurations may be used for bolt-action rifles, as well as for other types actions involving a bolt, including for example blowback and closed bolt actions, gas-operated or carbine actions, to name but a few.

Figure 5:
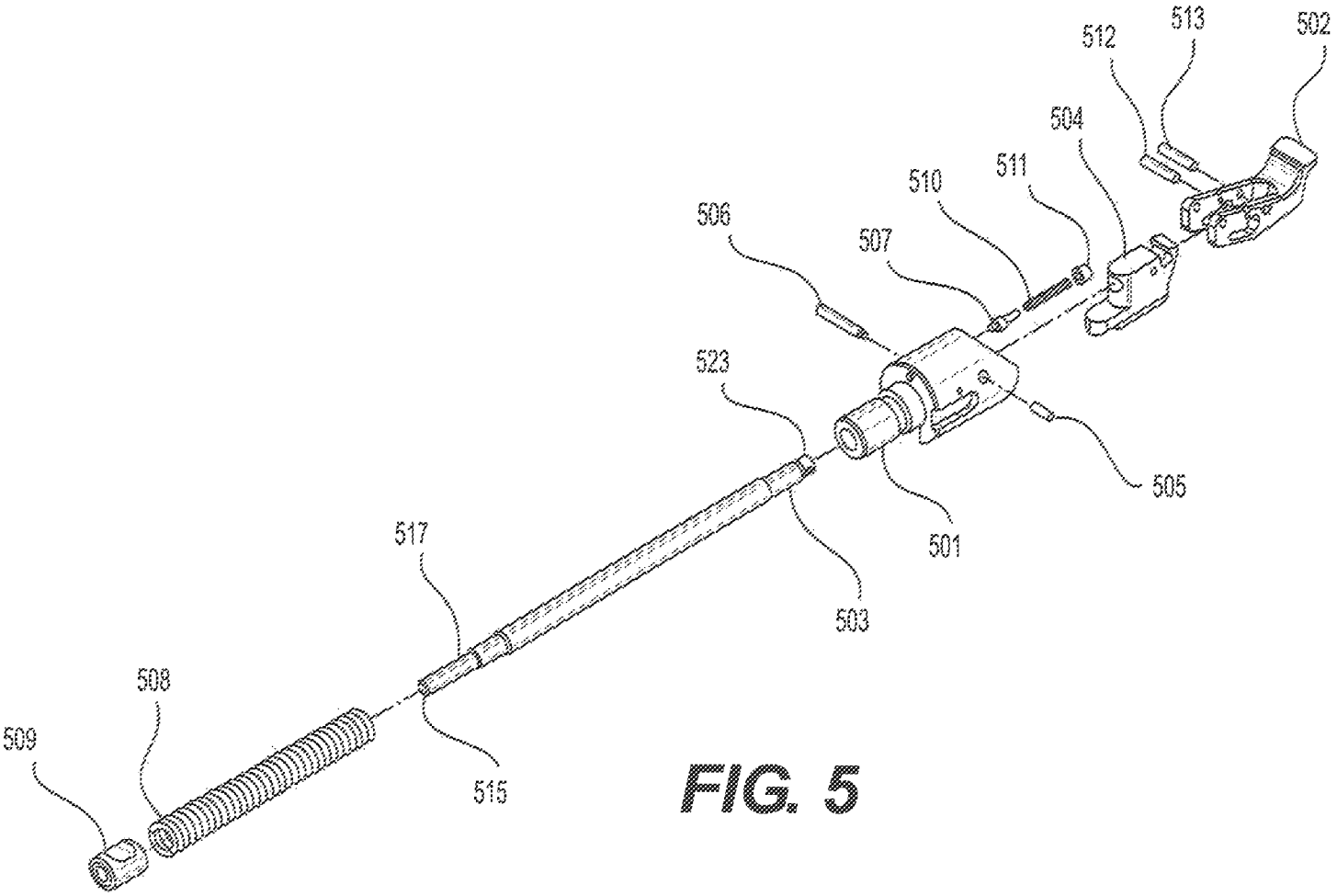
FIG. 5 is a schematic of an embodiment of a striker assembly.

The hollow bolt body may be configured to receive a striker assembly, such as the striker assembly embodiment shown in FIG. 5. In this embodiment, the striker assembly features a bolt sleeve 501 in mechanical connection with a cocking piece 504 and safety lever 502. A striker assembly may feature one of numerous types of safety levers. In the embodiment shown in FIG. 5, safety lever 502 is in mechanical connection with cocking piece 504 by parallel pins 512 and 513, and is in mechanical connection with bolt sleeve 501 through the spring-loaded pressure piece 505. Parallel pin 512 co-engages slot 519 of safety lever 502, and slot 521 of cocking piece 504. The safety lever 502 may be manually manipulated into different positions dictated by slots 519 and 521, changing the relative position of cocking piece 504 from e.g., a safe mode unable to engage the striker 503, to, e.g., a firing mode, in which striker 503 is able to contact a counter surface in a bolt head (not shown) to activate a floating firing pin. Spring-loaded pressure piece 505 may apply spring tension to the safety lever 502. Axle pin 506 fits into corresponding holes in bolt sleeve 501 and safety lever 502, and serves to allow the safety lever 502 to rotate about axle pin 506 to achieve different relative positions, e.g., safe mode and firing mode. Index pin 507, compression spring 510, and grub screw 511 fit into a recess in and protrude through a portion of the bolt sleeve 501, and encourage self-alignment of the bolt in the receiver/chassis (not shown) using spring pressure against a corresponding indentation in the receiver chassis.

In the embodiment shown in FIG. 5, the locking end 523 of striker 503 fits into
an opening on an end of the bolt sleeve 501 opposite from safety lever 502. Striker 503 is generally a long cylinder with changes in diameter along the long axis to accommodate other components. For instance, the diameter proximate the locking end 523 may be smaller than the largest diameter of the striker 503 to permit a specific portion of the striker 503 to fit into the bolt sleeve 501. Similarly, the diameter of the striker 503 proximate the contact surface 515 may be smaller than the largest diameter to permit a specific portion of the striker 503 to fit through a cylindrical bore in the sleeve 509, thereby keeping firing pin spring 508 in place along the long axis of the striker 503, and permitting that portion of striker 503 to make contact with an end of a firing pin in a bolt head (not shown). Once the action is cocked, engaging the firing mechanism (i.e., pulling a trigger) allows firing pin spring 508 to propel striker 503 forward, and if the bolt assembly is fully assembled, contact surface 515 of the striker 503 contacts the floating firing pin and pushes it forward through the front end of the bolt head to contact the primer.

Figure 6A:
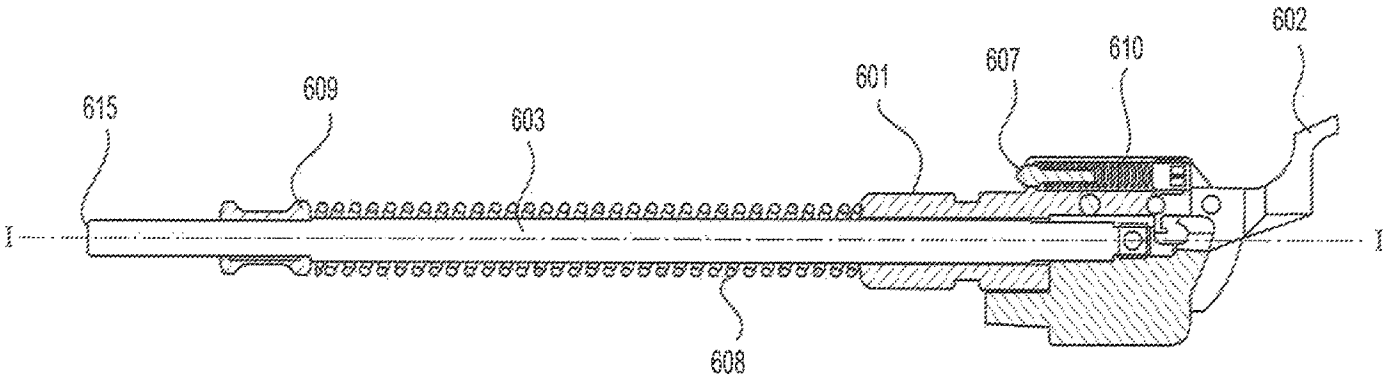
FIG. 6A shows a side cutaway and 6B a top cutaway of an assembled embodiment of a striker assembly.
Figure 6B:
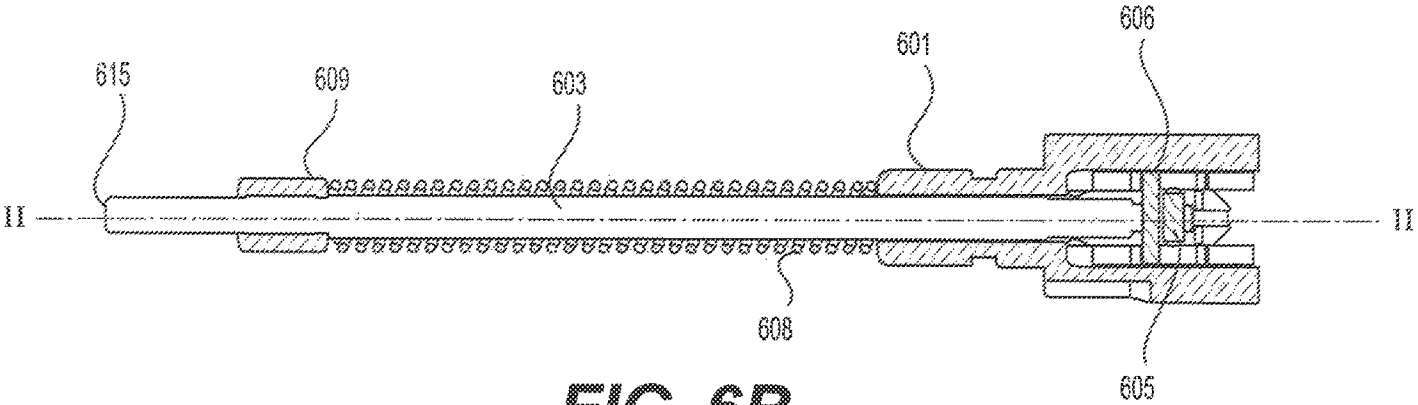

FIGS. 6A and 6B shows two cutaway views of an embodiment of an assembled striker assembly according to one aspect of the present disclosure. FIG. 6A is a side cutaway view taken along reference line II-II shown in FIG. 6B, and FIG. 6B is a top cutaway view taken along reference line I-I shown in FIG. 6A. Combined, the drawings show several of the striker assembly components discussed with respect to FIG. 5. Bolt sleeve 601 houses a portion of the striker 603 and is connected to the safety lever 602. Bolt sleeve 601 also houses a spring-loaded pressure pin 605, axle 606, index pin 607, and compression spring 610. Firing pin spring 608 is wrapped around striker 603, and is in mechanical engagement with the bolt sleeve 603 and the sleeve 609. Contact surface 615 is configured to mechanically engage a firing pin contact surface in a bolt head (not shown).

Figure 7:
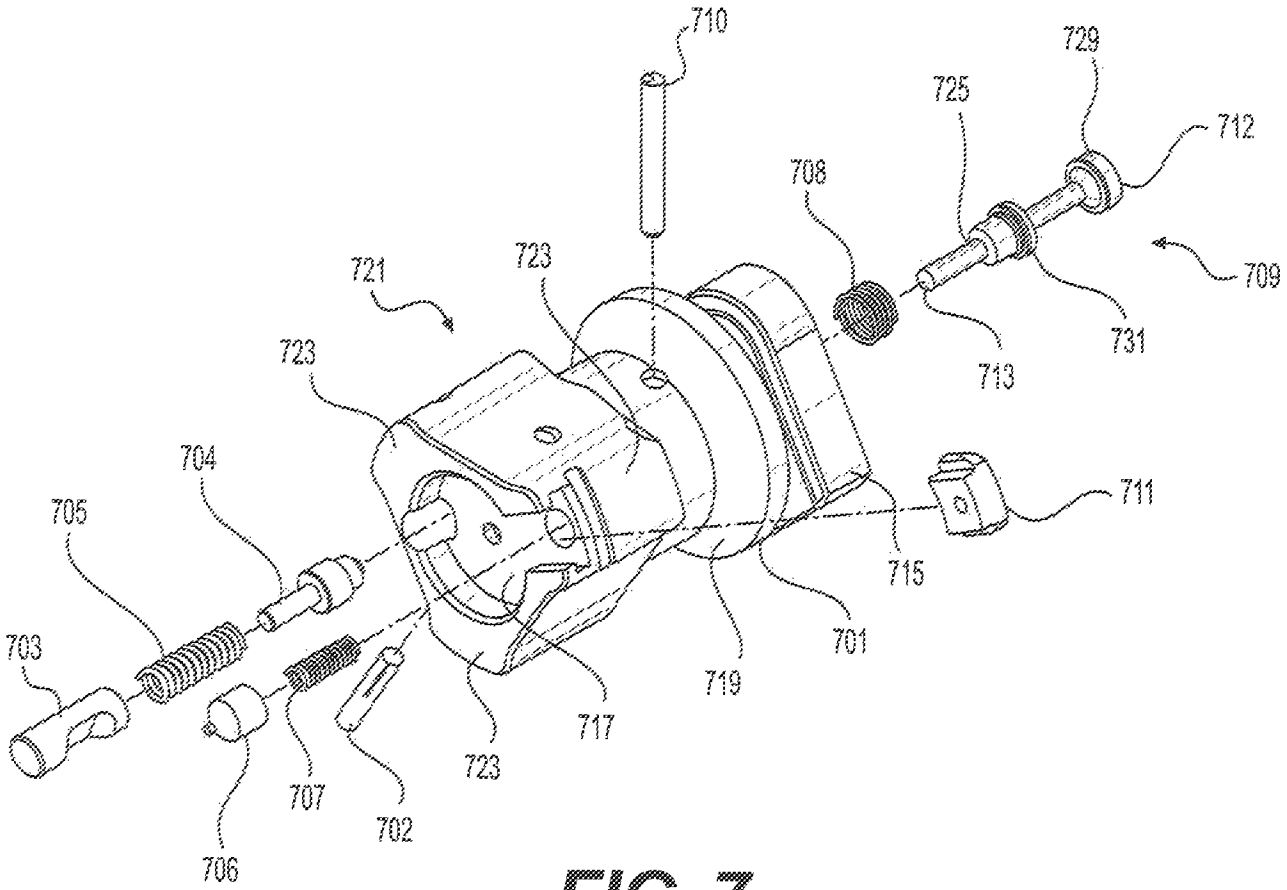
FIG. 7 shows a schematic of an embodiment of a bolt head with a floating firing pin.

FIG. 7 shows an embodiment of a bolt head 701 with a floating firing pin 709 according to the present disclosure. The bolt head 701 in this embodiment features a triangular head portion 721 configured to mate with a corresponding receiver and chassis system (not shown) using locking lugs 723, but a bolt head with a floating firing pin may have any shape appropriate to fit within a corresponding receiver and lock or unlock the bolt assembly in the desired position. For instance, the bolt head 701 in this embodiment may be inserted into a receiver and chassis system and rotated by 60 degrees, for example, to engage or disengage the locking lugs 723 in a barrel extension. Head portion 721 features an engagement surface 717 against which the generally flat striker end of an ammunition cartridge may contact. Typically, engagement surface 717 is configured to accommodate a specific caliber cartridge. For example, the diameter and/or depth of the engagement surface 717 may depend on the associated caliber cartridge. The engagement surface 717 features a small opening or hole through which primer contact surface 713 of the floating firing pin 709 may pass to contact the cartridge primer. In this embodiment, the floating firing pin 709 may be positioned inside the bolt head 701 when fully assembled. Compression spring 708 biases the floating firing pin 709 in a retracted position away from the engagement surface 717.

The shape of the floating firing pin may depend on a number of design factors, such as the manner in which the floating firing pin 709 is retained by the bolt head and moves through the bolt head. In the embodiment shown, the floating firing pin 709 has an hourglass body. The cylindrical portion 725 at the front end of the floating firing pin 709 is configured to protrude through the small opening or hole of the engagement surface 717, which in turn enables primer contact surface 713 to strike the primer when the firing mechanism is engaged. Because of the spring force, the floating firing pin 709 does not move toward the small opening, and thus does not contact the primer, unless a sufficient force acts upon it. A striker assembly such as discussed above may be configured to provide the force to overcome the spring tension on the firing pin 709 when a user engages the firing mechanism. Also, spring-loading the floating firing pin as shown in this embodiment essentially eliminates dwell time. Larger cylindrical portion 727 may be used to seat the compression spring 708, which rests against pin flange 731 and a counter-surface (not shown) inside the bolt head 701. Backside flange 729 limits the movement of the floating firing pin 709 inside the bolt head 701 as will be discussed elsewhere herein. As can be seen, the body of the floating firing pin 709 in this embodiment has an hourglass shape, forming a gap between flanges 731 and 729. The gap may conform to the shape of spiral pin 710 to keep the floating firing pin 709 in position, and also traps debris from routine operation of the firearm. The floating firing pin 709 also includes striker contact surface 712 for contacting the front end of a striker of a striker assembly (not shown), such as the striker assembly embodiments in FIGS. 5 and 6. Disconnecting the firing pin from the striker, such as shown in this embodiment, allows the firing pin to float in the bolt head and prevents the firing mechanism from engaging unless the bolt assembly is properly assembled and inserted into the firearm.

A bolt head with a floating firing pin may feature means for removably connecting to a hollow bolt body and striker assembly. The connection means may also force the components to self-align, such that the bolt assembly (and thus the firing mechanism) cannot operate if the components are not properly connected and aligned. In the embodiment shown in FIG. 7, T-shaped locking structure 715 is configured to slidably mate or interlock with a corresponding T-shaped groove in a bolt body, such as the bolt body embodiment shown in FIG. 4. In this embodiment, the bolt head 701 may be manually connected to a hollow bolt body by pressing the T-shaped locking structure 715 into a corresponding T-shaped groove, thereby interlocking the components and aligning the bolt head 701 for proper insertion into a receiver/chassis system (not shown) and proper mechanical interaction with other components of the firearm.

Bolt head portion 721 may feature an extractor mechanism, such as the extractor 711, extractor detent 706, and compression spring 707 mechanisms shown in the embodiment depicted in FIG. 7. The following generally describes a procedure for a cycle of operation:

A. Loading:

Loading requires the manual operation of pushing the bolt assembly forward causing the bolt head to strip a cartridge from the magazine and feed/push it into the chamber than locking the bolt assembly into the barrel extension. The extractor mechanism (711) is configured to snap over by way of extractor detent 706 and extractor compression spring 707 and clamp a portion of the cartridge case securing it to the bolt face.

B. Un-Locking/Un-Loading

Once the cartridge is fired, the manual operation of un-locking the bolt assembly is required to remove the spent casing which is the first part of the un-loading sequence. The manual operation of lifting the Bolt Arm in an upward motion (un-locking) the bolt assembly from the chamber and or barrel extension.

C. Extraction:

After unlocking occurs the manual operation of retracting the bolt assembly rearward to remove the spent/empty casing from the chamber is called extraction, this operation is made possible by way of the extractor mechanism 711 which during the loading sequence has already clamped a portion of the rim of the cartridge case.

D. Ejection

As the Bolt Assembly continues to extract the spent cartridge case the ejector mechanism (703) is configured to apply continuous upward force by way of the Ejector Compression Spring (705) to the base of spent cartridge case. As the rearward movement of the Bolt Assembly continues the ejector is placing continued spring loaded force on the base of the casing, only until the neck and shoulder of the spent casing clear the ejection port opening of the receiver the applied force of the ejector violently throws the spent casing out of the control of the Extractor and away from the receiver of the rifle.

E. Loading:

The cycle of operation is repeated.

Figure 8A:
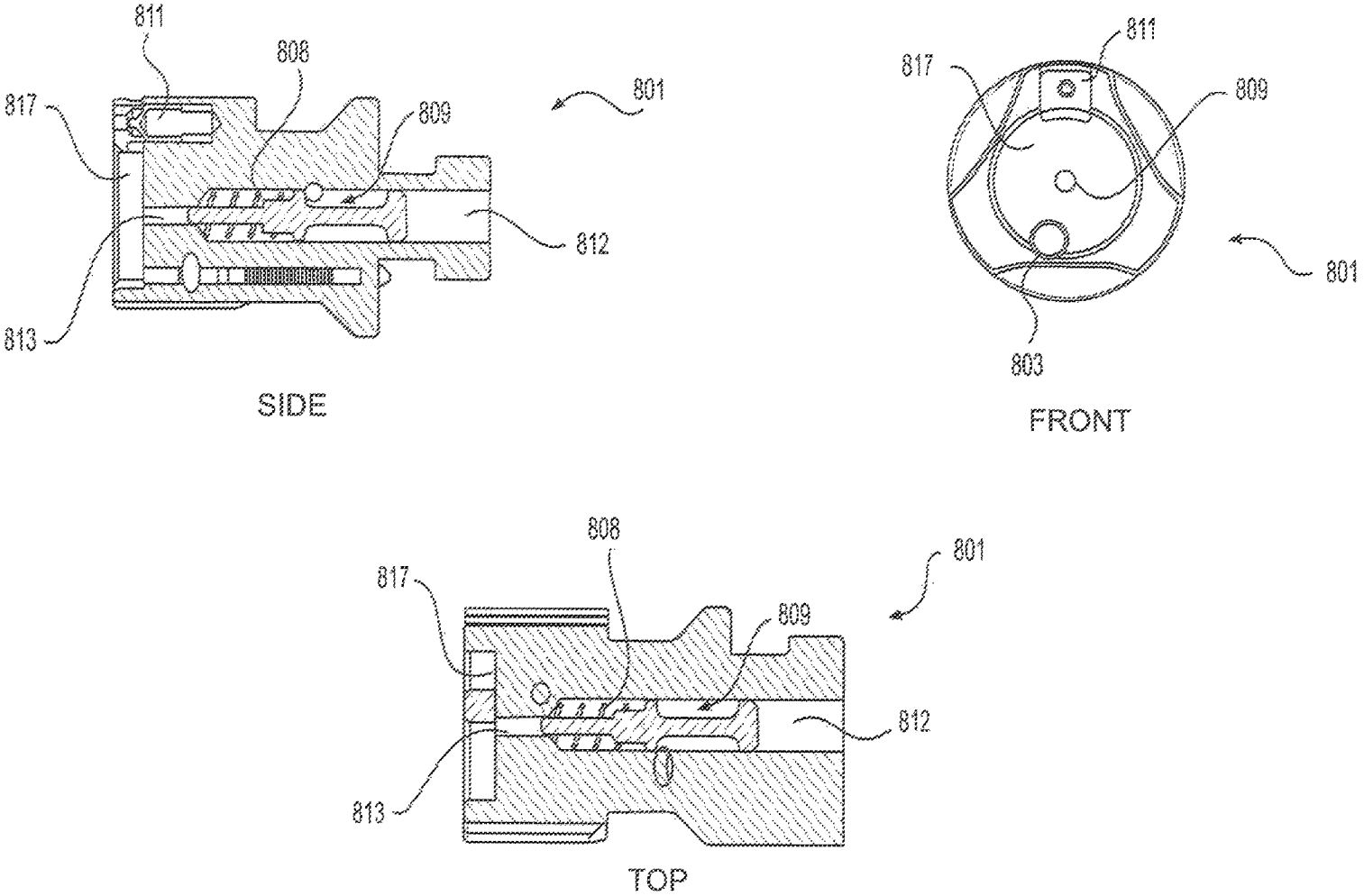
FIGS. 8A and 8B show side, front, and top views of an embodiment of a bolt head 801 with a floating firing pin 809 in (a) a retracted position, and (b) an firing position, respectively.
Figure 8B:
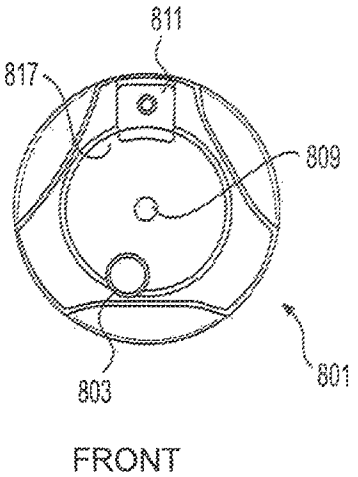
Figure 8B:
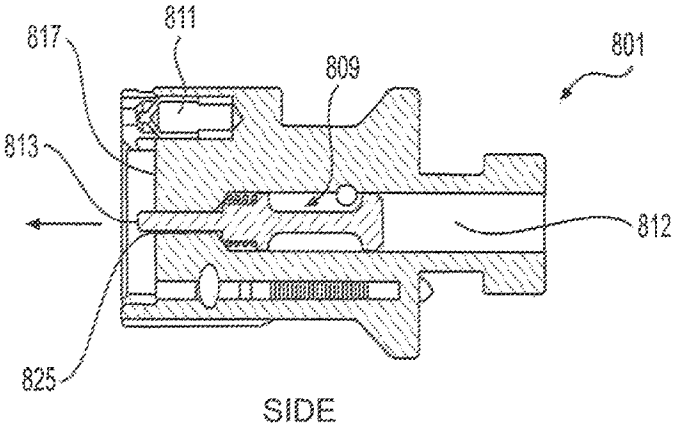
Figure 8B:
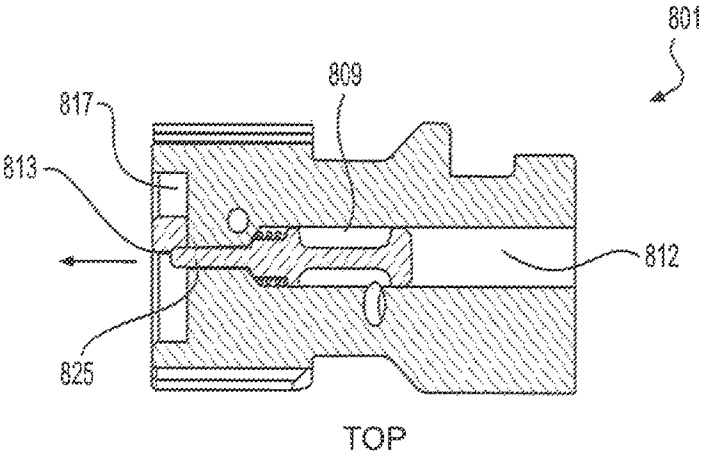

FIGS. 8A and 8B show side, front, and top views of an embodiment of a bolt head 801 with a floating firing pin 809. FIG. 8A shows the floating firing pin 809 in a retracted position, in which compression spring 808 biases the firing pin 809 away from the opening on engagement surface 817. The extractor mechanism 811 is described above, with respect to FIG. 7. The bolt head 801 may be in the retracted position when separate from the bolt assembly, and if desired, the bolt head 801 may be configured to remain in the retracted position when assembled with a bolt body (not shown) and striker assembly (also not shown). For instance, the relative positions of the components may be configured such that the striker assembly makes minimal contact with striker contact surface 812, thereby not altering the position of the firing pin 809, until the firing mechanism is engaged. As can be seen in the drawings, the bolt head 801 in this embodiment includes a channel for receiving a portion of the striker assembly that, upon engaging the firing mechanism, contacts striker contact surface 812. Alternatively, the striker assembly may contact the striker contact surface 812 when the bolt assembly is assembled, such that the floating firing pin 809 moves forward by a predetermined distance. For example, a portion of the striker may remain in the channel and in contact with striker contact surface 812, such that upon engaging the firing mechanism, the striker and striker contact surface 812 overcome spring tension and move forward for primer contact surface 813 to contact a cartridge.

FIG. 8B shows the floating firing pin 809 in an engaged or firing position, such as when the firing mechanism has been engaged. As can be seen, the firing pin 809 has moved forward in the direction of the arrow such that cylindrical portion 825 partially protrudes through the opening in engagement surface 817, thereby permitting primer contact surface 813 to contact a cartridge primer (not shown). The engaged configuration shown in FIG. 8B may be caused by a striker assembly (not shown) striking striker contact surface 812 with sufficient force to overcome the spring tension from spring 808, such as when a trigger is pulled, releasing a striker forward to contact the firing pin 809. Typically, the firing pin 809 remains in the firing position shown in FIG. 8(*b*) for a short period of time, because compression spring 808 forces the firing pin 809 to retract immediately after the striker (not shown) retracts.

Figure 9A:
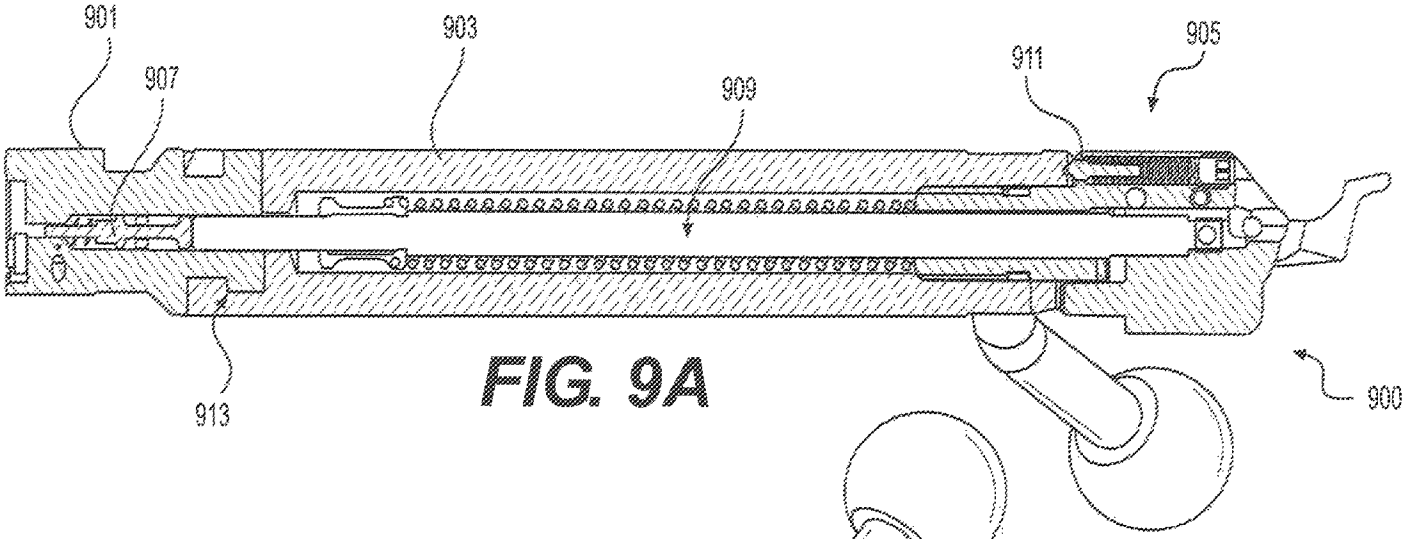
FIGS. 9A and 9B show schematics of an assembled embodiment of a modular bolt assembly according to the present disclosure.
Figure 9B:
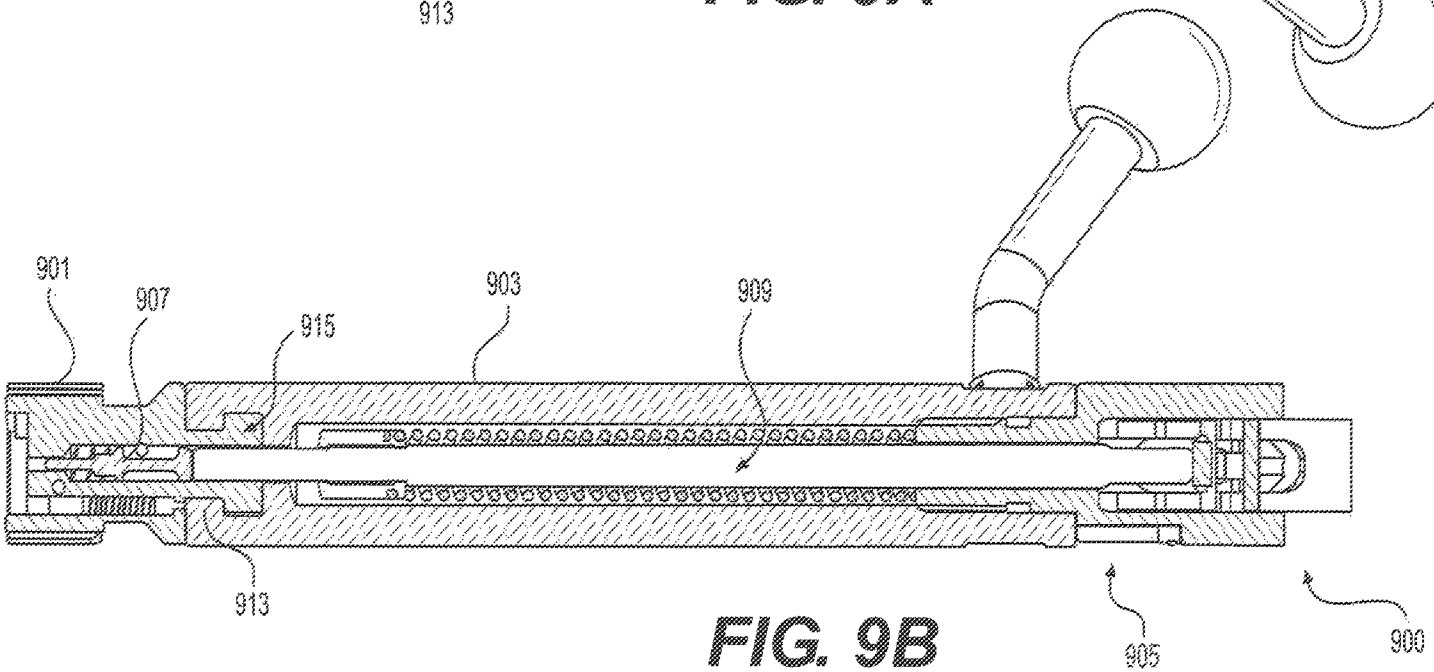

FIGS. 9A and 9B show side and top schematics of an assembled embodiment of a modular bolt assembly 900 according to the present disclosure. The bolt assembly 900 includes bolt head 901 with a floating firing pin 907, hollow bolt body 903, and striker assembly 905. Striker assembly 905 is mated with the hollow bolt body 903 by threaded connections (not shown), and held in properly alignment by index pin 911. Bolt head 901 is mated with the hollow bolt body 903 by locking mechanism 913, including T-shaped interlock 915 as described above. As can be seen, firing pin 907 is in contact with striker 909, such that forward movement by the striker 909, such as from engagement of the firing mechanism, also moves the firing pin 907 forward to contact a cartridge primer (not shown).

The terminology used herein is for the purpose of describing particular embodiments only and is not intended to be limiting of the approach. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present approach may be embodied in other specific forms without departing from the spirit or essential characteristics thereof. The present embodiments are therefore to be considered in all respects as illustrative and not restrictive, the scope of the disclosure being indicated by the claims of the application rather than by the foregoing description, and all changes which come within the meaning and range of equivalency of the claims are therefore intended to be embraced therein.

What is claimed is:

1. A removable bolt head for a modular bolt assembly, the bolt head comprising:

a cartridge engagement surface, a back end configured to removably mate with a bolt body, a longitudinal bore extending between the cartridge engagement surface and the back end, the longitudinal bore having a length, a detent member positioned in the bore, and a floating firing pin secured within the bolt head and having a primer contact surface and a striker contact surface, wherein the floating firing pin is positioned in the longitudinal bore and comprises a pin flange configured to contact the detent member when the floating firing pin is in a retracted position, thereby securing the floating firing pin in the bolt head, and further wherein the length of the floating firing pin is less than the length of the longitudinal bore.

2. The bolt head of claim 1, wherein the floating firing pin comprises a front end configured to contact a cartridge primer, and a rear end configured to receive force from a striker assembly.

3. The bolt head of claim 1, further comprising a head portion and plurality of locking lugs, the head portion and locking lugs configured to mate with a corresponding receiver and chassis system.

4. The bolt head of claim 3, wherein the head portion defines the cartridge engagement surface for contacting an associated caliber cartridge.

5. The bolt head of claim 1, wherein the cartridge engagement surface comprises an opening through which the floating firing pin's primer contact surface may pass to contact a cartridge.

6. The bolt head of claim 5, wherein the floating firing pin has an hour glass body with a front end and a back end, and a cylindrical portion extending from the body's front end, the cylindrical portion defining the primer contact surface.

7. The bolt head of claim 1, wherein the floating firing pin is mounted within the bolt head.

8. The bolt head of claim 1, further comprising a spring that biases the floating firing pin in a retracted position away from the bolt head's cartridge contact surface.

9. The bolt head of claim 1, wherein the bolt's back end comprises a T-shaped locking structure for removably mating with the bolt body.

10. The bolt head of claim 9, wherein a portion of the cylindrical portion is configured to pass through the engagement surface opening to contact a cartridge.

11. The bolt head of claim 1, wherein the bolt head further includes a channel for receiving a portion of a striker assembly, the floating firing pin positioned in the channel such that the portion of a striker assembly may contact the striker contact surface.

12. A modular bolt assembly comprising:

a bolt body, a striker assembly, a removable bolt head comprising a longitudinal bore having a length, a detent member positioned in the bore, and a floating firing pin secured within the bolt head, wherein the floating firing pin is positioned in the longitudinal bore and comprises a pin flange configured to contact the detent member when the floating firing pin is in a retracted position, thereby securing the floating firing pin in the bolt head, and further wherein the length of the floating firing pin is less than the length of the longitudinal bore.

13. The bolt assembly of claim 12, further comprising a self-aligning locking mechanism configured to enable the removable bolt head to removably mate with the hollow bolt body.

14. The bolt assembly of claim 13, wherein the self-aligning locking mechanism includes a T-shaped locking structure and corresponding T-shaped groove.

15. The bolt assembly of claim 12, wherein the bolt body comprises a bore for receiving a portion of the striker assembly.

16. The bolt assembly of claim 15, wherein the striker assembly is configured to removably mate with the bolt body, such that a portion of the striker assembly extends through the bolt body's bore.

17. The bolt assembly of claim 16, wherein the bolt head includes a channel for receiving a portion of the striker assembly extending from the bolt body's bore, such that an end of the striker assembly contacts the striker contact surface of the floating firing pin.

18. A modular firearm comprising:

a barrel;

a receiver and chassis;

a bolt assembly, the bolt assembly comprising a bolt body, a striker assembly, a longitudinal bore having a length, a detent member positioned in the bore, and a removable bolt head having a floating firing pin secured within the bolt head, wherein the floating firing pin is positioned in the longitudinal bore and comprises a pin flange configured to contact the detent member when the floating firing pin is in a retracted position, thereby securing the floating firing pin in the bolt head, and further wherein the length of the floating firing pin is less than the length of the longitudinal bore.

19. A modular bolt assembly system comprising:

a bolt body, a striker assembly, and a plurality of bolt heads, each bolt head (a) configured for use with an associated caliber cartridge, (b) configured for removable mating with the bolt body, (c) comprising a longitudinal bore having a length, wherein a detent member is positioned in the longitudinal bore, and (de) having a floating firing pin secured within the bolt head, wherein the floating firing pin is positioned in the longitudinal bore and comprises a pin flange configured to contact the detent member when the floating firing pin is in a retracted position, thereby securing the floating firing pin in the bolt head, and further wherein the length of the floating firing pin is less than the length of the longitudinal bore.

20. A method of striking a cartridge primer with a floating firing pin, the method comprising:

engaging a firing mechanism connected to a modular bolt assembly having a bolt body, a striker assembly, and a bolt head, the bolt head removably mated with the bolt body, the bolt head comprising a longitudinal bore having a length, wherein a detent member is positioned in the longitudinal bore, and wherein a floating firing pin, wherein the floating firing pin is positioned in the longitudinal bore and comprises a pin flange configured to contact the detent member when the floating firing pin is in a retracted position, thereby securing the floating firing pin in the bolt head, and further wherein the length of the floating firing pin is less than the length of the longitudinal bore, wherein engaging the firing mechanism propels the striker assembly toward a striker contact surface of the floating firing pin;

contacting the striker contact surface of the floating firing pin with the striker assembly;

pushing the floating firing pin toward a cartridge contact surface of the bolt head, a distance sufficient for a primer contact surface of the floating firing pin to protrude through an opening in the cartridge contact surface of the bolt head and contact the cartridge primer.

21. The method of claim 20, wherein contacting the striker contact surface of the floating firing pin with the striker assembly comprises the striker assembly exerting a pushing force on the floating firing pin adequate to overcome a spring tension on the floating firing pin, thereby causing the floating firing pin to move in the direction of the cartridge.

* * * * *